US007922558B2

(12) United States Patent
Huang

(10) Patent No.: US 7,922,558 B2
(45) Date of Patent: Apr. 12, 2011

(54) ELECTRONIC CAKE

(75) Inventor: Bao-Jun Huang, Shenzhen (CN)

(73) Assignees: Hong Fu Jin Precision Industry (Shenzhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 192 days.

(21) Appl. No.: 12/432,747

(22) Filed: Apr. 29, 2009

(65) Prior Publication Data

US 2010/0159797 A1 Jun. 24, 2010

(51) Int. Cl.
*A63H 33/00* (2006.01)

(52) U.S. Cl. ..... 446/485

(58) Field of Classification Search ..... 446/485
See application file for complete search history.

(56) References Cited

U.S. PATENT DOCUMENTS 4,187,532 A * 2/1980 Naffier ..... 362/186
5,582,478 A * 12/1996 Ambrosino ..... 362/234
6,171,170 B1 * 1/2001 Lin ..... 446/404

FOREIGN PATENT DOCUMENTS

CN 1673047 A * 9/2005

* cited by examiner

*Primary Examiner* — Alvin A Hunter
*Assistant Examiner* — Amir Klayman
(74) *Attorney, Agent, or Firm* — Frank R. Niranjan

(57) ABSTRACT

An electronic cake includes an inner base, an outer base, a driving device, a bottom shell, a rotatable platform, a number of candle-like lamps, a controlling device and a power source. The outer base is loosely sleeved on the inner base forming a predetermined guiding groove there-between. The bottom shell is rotatably received in the inner base by the driving device. The rotatable platform is attached on the bottom shell. The candle-like lamps are slidably attached on the rotatable platform. Each candle-like lamp has a supporting leg extending out from a side wall of the rotatable platform and received in the predetermined guiding groove. The controlling device is positioned in the rotatable platform. The power source is electrically connected to the driving device and the candle-like lamps via the controlling device for supply driving electric power to the driving device and the candle-like lamps.

15 Claims, 6 Drawing Sheets

ELECTRONIC CAKE

BACKGROUND

1. Technical Field

The disclosure relates to electronic toys and, more particularly, to an electronic cake.

2. Description of Related Art

Toys are popular with both children and adults. One kind of toys that is popular with adults is a cake toy. The cake toy can be used as a toy and also as a decoration for select occasion. This cake toy is usually decorated with candle-like accessories to make them more appealing. However, most of these accessories are stationary on the cake toy, and thus may not maintain the attention of the audience.

Therefore, what is needed is to provide an electronic cake, in which the above problem is eliminated or at least alleviated.

DETAILED DESCRIPTION

Figure 1:
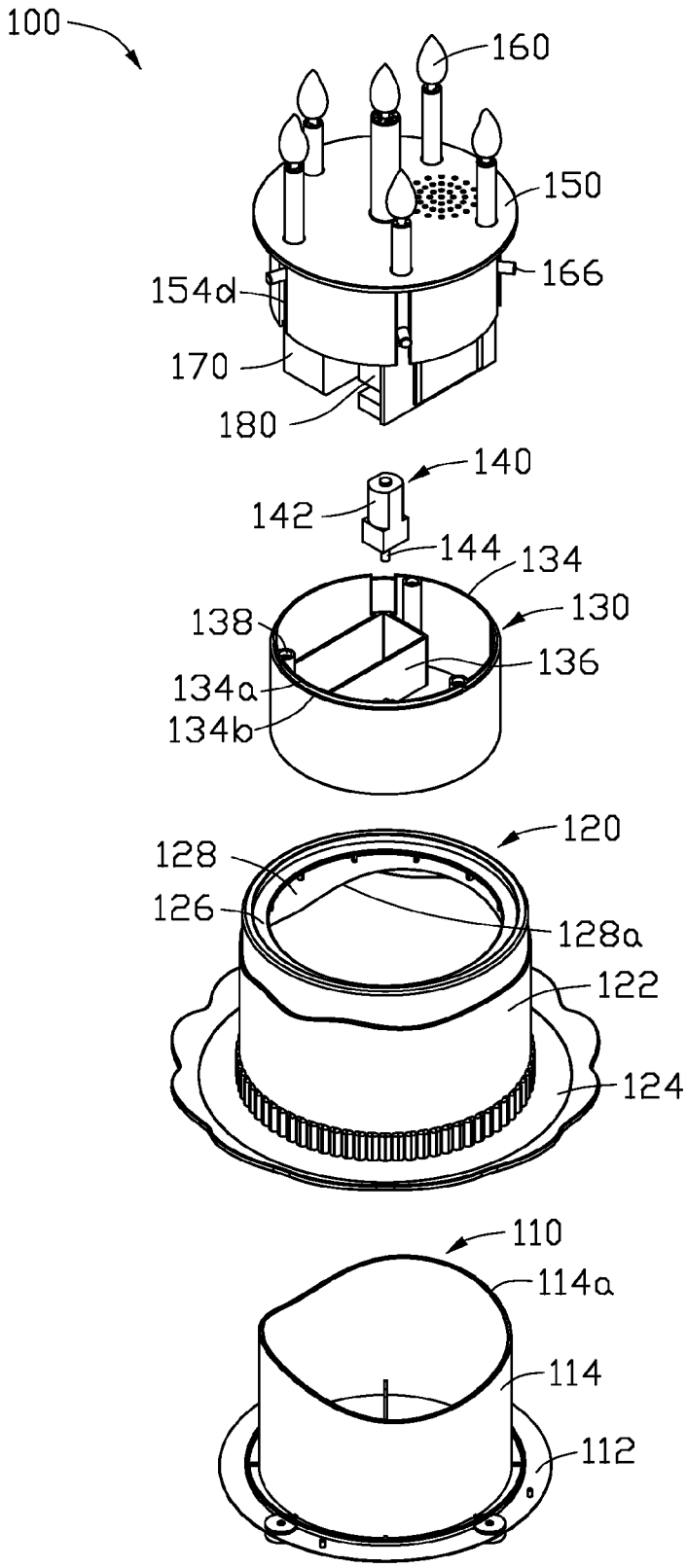
FIG. 1 is an isometric, exploded view of an electronic cake according to an exemplary embodiment.

Referring to FIG. 1, an electronic cake 100, according to an exemplary embodiment, includes an inner base 110, an outer base 120, a bottom shell 130, a driving device 140, a rotatable platform 150, a number of candle-like lamps 160, a power source 170, and a controlling device 180.

Referring to FIGS. 1 to 4, the outer base 120 is loosely sleeved on the inner base 110 and cooperatively define a predetermined guiding groove 190 between an upper rim of the inner base 110 and a bottom surface of the outer base 120. The rotatable platform 150 is attached on the bottom shell 130 to cooperatively form a receiving space (not label) for receiving the driving device 140, the power source 170, and the controlling device 180.

The driving device 140 includes a body 142 and a rotor 144 rotatably connected to the body 142. The rotor 144 protrudes from the bottom shell 130. The bottom shell 130 and the rotatable platform 150 are rotatably received in the inner base 110 with the rotor 144 of the driving device 140 engaged with the inner base 110.

The candle-like lamps 160 are slidably attached to the rotatable platform 150. Each of the candle-like lamps 160 includes a supporting leg 166 that protrudes out through the side wall of the rotatable platform 150. The supporting legs 166 are slidably engaged in the fluctuant guiding groove 190. When the supporting legs 166 slide in the fluctuant guiding groove 190 following the rotation of the rotatable platform 150, the candle-like lamps 160 correspondingly supported by the supporting legs 166 rotate and move upwards and downwards.

The power source 170 is electrically connected to the driving device 140 and the candle-like lamps 160 and is configured for supplying electric power to the driving device 140 and the candle-like lamps 160. The controlling device 180 is fixed to the bottom shell 130 or the rotatable platform 150. The controlling device 180 is configured for controlling the driving device 140 and the candle-like lamps 160, e.g., activating or deactivating the driving device 140 and the candle-like lamps 160.

Figure 2:
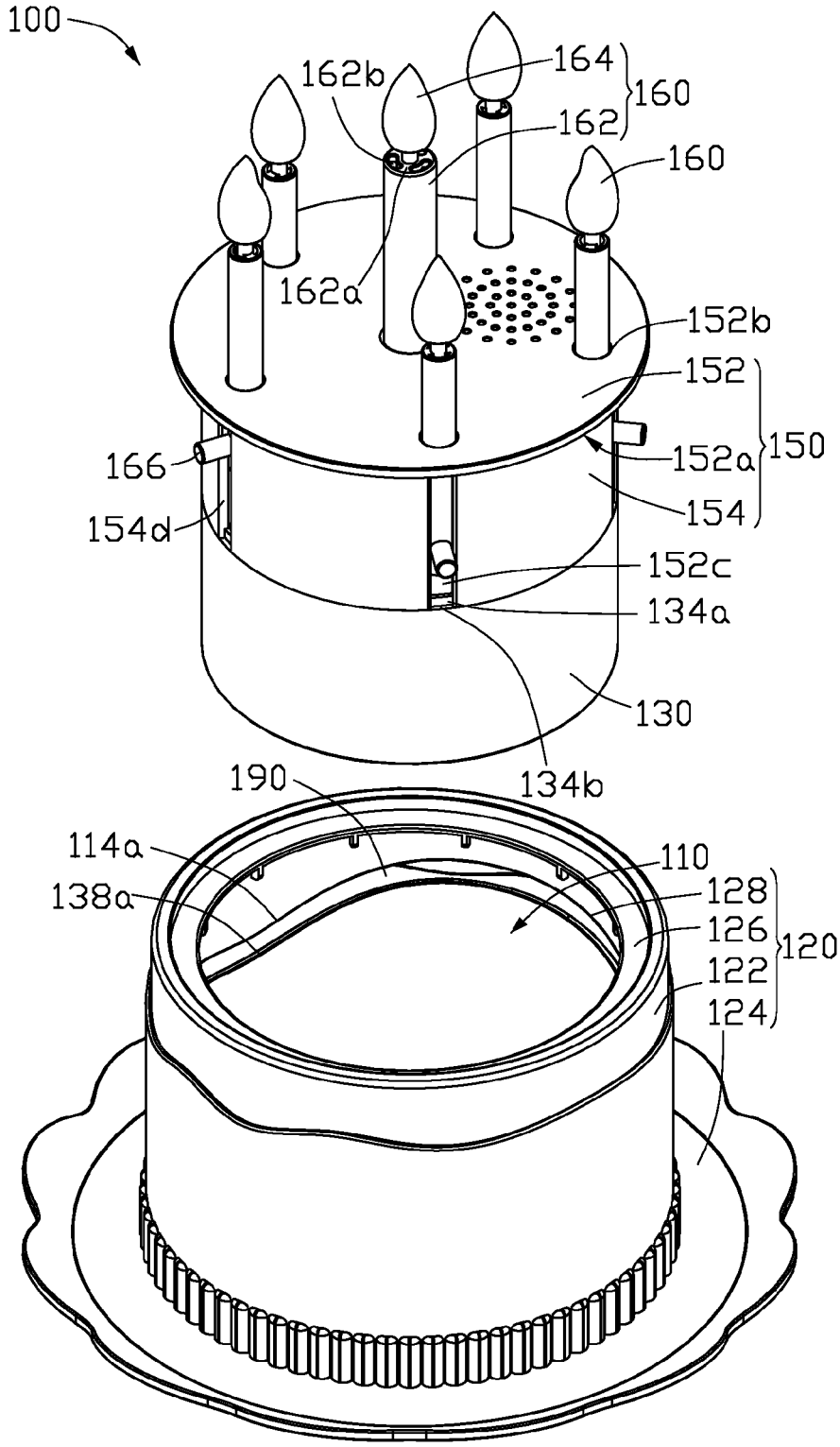
FIG. 2 is a partially assembled isometric view of the electronic cake FIG. 1.
Figure 3:
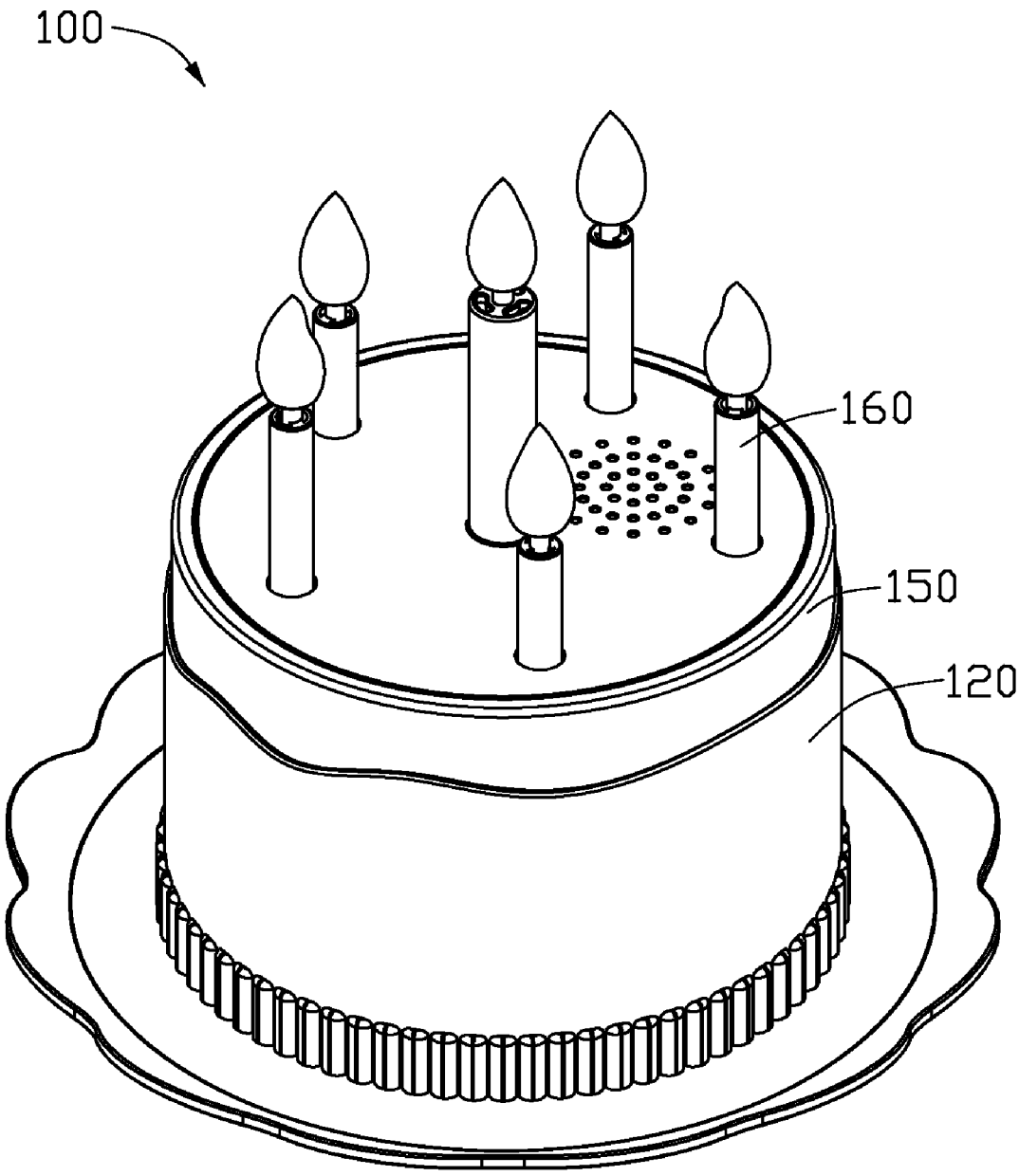
FIG. 3 is an isometric view of the electronic cake of FIG. 1.
Figure 4:
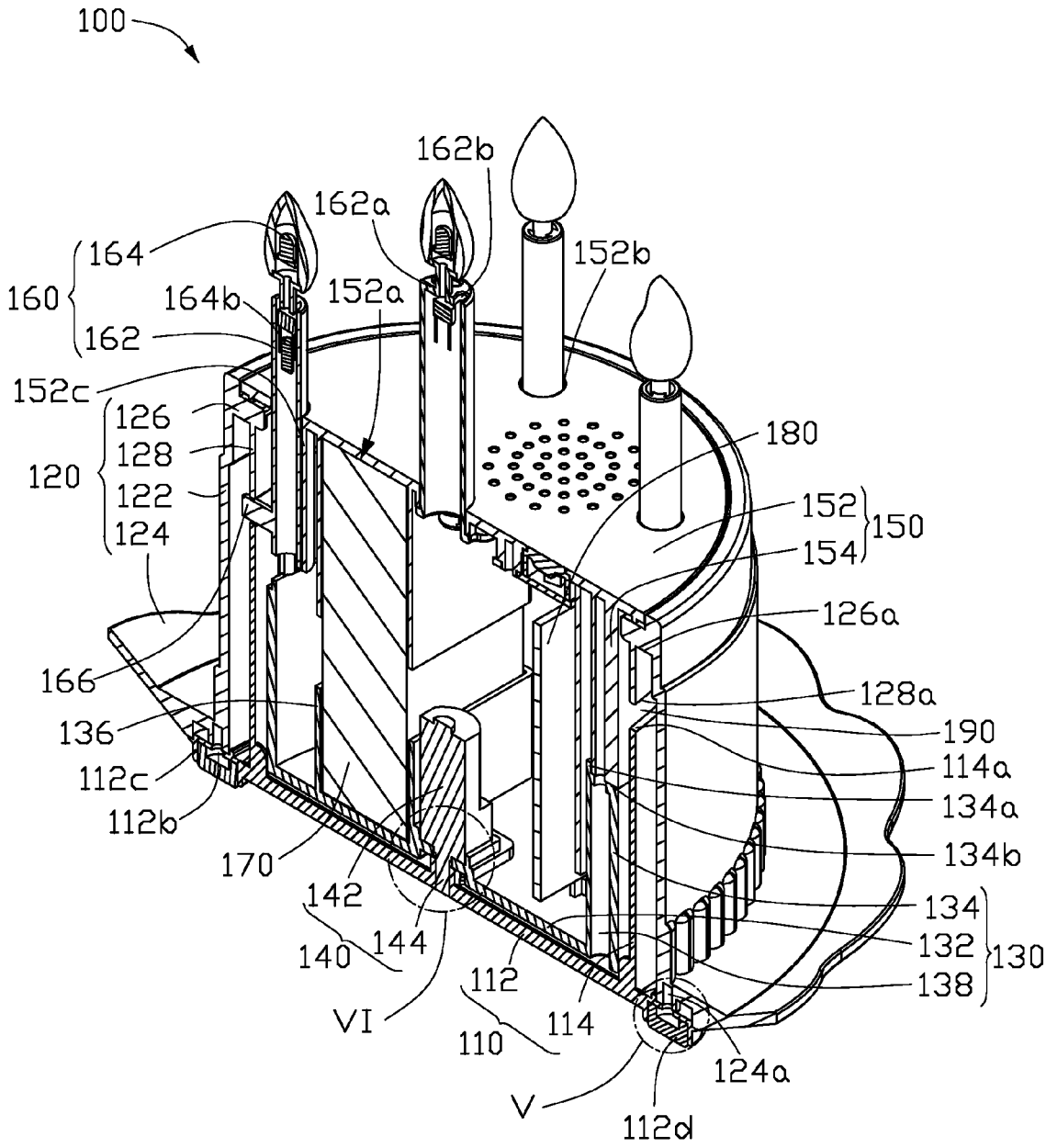
FIG. 4 is a cross-sectional view of the electronic cake of FIG. 3.
Figure 5:
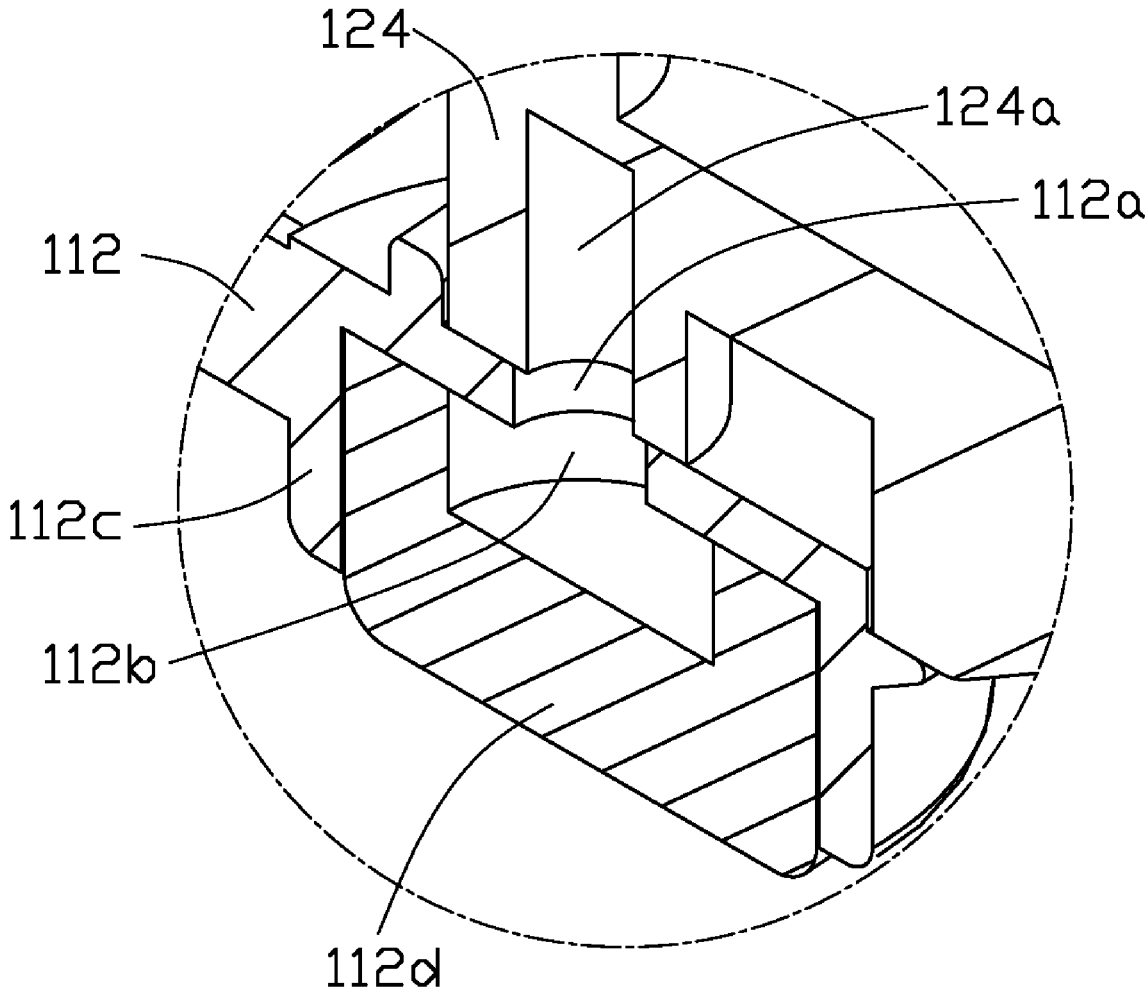
FIG. 5 is an enlarged view of a section V in the electronic cake of FIG. 4.
Figure 6:
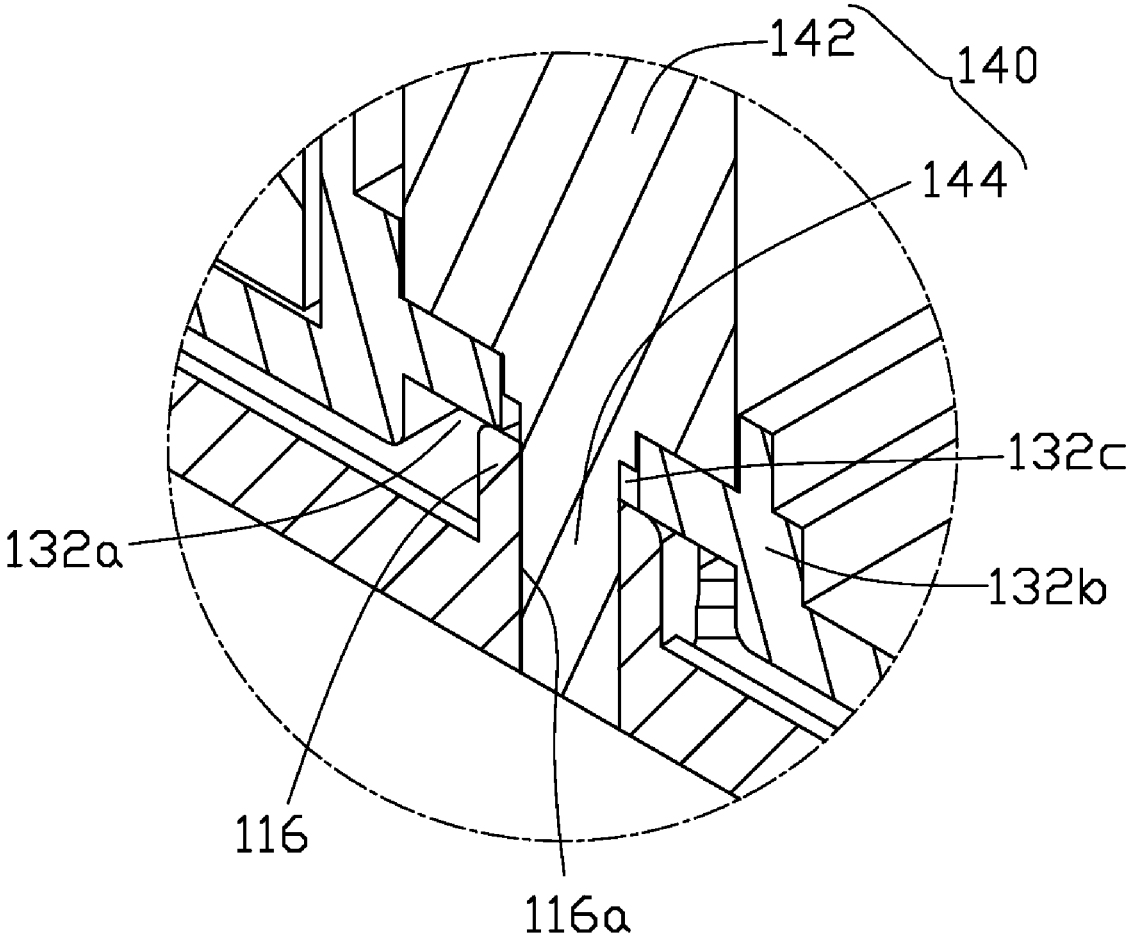
FIG. 6 is an enlarged view of a section VI in the electronic cake of FIG. 4.

Referring to FIGS. 4 and 5, the inner base 110 includes a substrate 112, and a cylindrical wall 114 on the substrate 112. A number of positioning holes 112*a* are defined along the periphery of the substrate 112. A number of bolts (not shown) are passed through the positioning holes 112*a* correspondingly to fix the outer base 120 on the substrate 112 of the inner base 110. A number of counterbores 112*b* are defined in the substrate 112, surrounding the corresponding positioning holes 112*a* of the substrate 112 and communicating with the corresponding positioning holes 112*a*. A number of flanges 112*c* are formed on the substrate 112 and encircle the counterbores 112*b* and the positioning holes 112*a*. A number of pads 112*d* are disposed in the spaces defined by the positioning holes 112*a*, counterbores 112*b*, and the flanges 112*c*. Referring to FIG. 6, a bulge 116 protrudes upwards from the center portion of the substrate 112. A shaft hole 116*a* is defined through the bulge 116 and the substrate 112 for fixedly receiving the rotor 144 of the driving device 140. Referring to FIGS. 1 and 2, the cylindrical wall 114 includes a curved upper cam end 114*a* defining a cam surface of the guiding groove 190.

Referring to FIG. 4, the outer base 120 is mounted on the substrate 112 of the inner base 110 and wraps around the cylindrical wall 114 of the inner base 110. The outer base 120 includes a cylindrical outer wall 122 having a radius greater than that of the cylindrical wall 114. Therefore, the cylindrical outer wall 122 and the cylindrical wall 114 can cooperatively define a receiving space there-between for the supporting legs 166 of the candle-like lamps 160 received therein. A flange portion 124 protrudes outwards from one end of the cylindrical outer wall 122, and a projection 126 protrudes inward from the other end of the cylindrical outer wall 122.

Referring to FIG. 5, the flange portion 124 defines a number of threaded holes 124*a* thereon corresponding to the positioning holes 112*a* of the base 110. A number of bolts (not shown) are passed through the positioning holes 112*a* and screwed in the threaded holes 124*a* to fixedly connect the inner base 110 to the outer base 120.

Referring to FIGS. 2 and 4, the projection 126 includes a lower surface 126*a* facing the substrate 112. An inner wall 128 perpendicularly projects downward from the low surface 126*a*. The inner wall 128 is cylindrical having an inner radius approximately equal to that of the cylindrical wall 114 and spaced from the cylindrical wall 114 by a predetermined distance when the outer base 120 is mounted on the inner base 110. The inner wall 128 has a curved lower cam end 128*a* corresponding to and aligned with the curved upper cam end 114*a*. Therefore, the curved lower cam end 128*a* and the curved upper cam end 114*a* cooperatively form the guiding groove 190.

Referring to FIGS. 1, 4 and 6, the bottom shell 130 is rotatably positioned in the substrate 112 and is surrounded by the cylindrical wall 114. The bottom shell 130 includes a base sheet 132 and a cylindrical side wall 134 extending along a circumference of the base sheet 132. A cavity 132*a* is defined in the center of a surface of the base sheet 132 corresponding to and receiving the bulge 116 to allow the bottom shell 130 to rotate with respect to the bulge 116. A stepped protrusion 132*b* is formed on another surface of the base sheet 132 corresponding to the cavity 132*a*, and defines a through hole 132*c*. A case 136 is formed on the base sheet 132 adjacent to the protrusion 132*b*, for receiving the power source 170. A number of positioning poles 138 are evenly formed on an inner surface of the side wall 134. A number of bolts (not shown) pass through the positioning poles 138 to fix the rotatable platform 150 on the bottom shell 130. Along the inner circumference of the cylindrical side wall 134, a rib 134*a* protrudes upwards from an upper end 134*b* of the cylindrical side wall 134 and abuts the rotatable platform 150 for firmly positioning the rotatable platform 150.

The driving device 140 is positioned in the bottom shell 130 with the body 142 fixed on the protrusion 132*b*, and the rotor 144 protruding from the through hole 132*c* of the bottom shell 130. Therefore, the body 142 is fixed on the base sheet 132. The rotor 144 is fixedly received the shaft hole 116*a*.

Referring to FIGS. 1 and 4, the rotatable platform 150 is mounted on the side wall 134 of the bottom shell 130. The rotatable platform 150 includes a top sheet 152 having a bottom surface 152*a*, and a support 154 extending from the bottom surface 152*a*. The top sheet 152 defines a number of through holes 152*b*. The rotatable platform 150 further includes a number of tubes 152*c* extending downwards from the bottom surface 152*a* and communicating with responding through holes 152*b*. The candle-like lamps 160 are slidably received in the corresponding tubes 152*c*. A number of sliding slots 154*d* are defined on the support 154 along the axis of the adjacent tube 152*c* corresponding to the tubes 152*c*. Each of the sliding slots 154*d* runs through the adjacent tubes 152*c* for allowing the supporting legs 166 extending out from the sliding slots 154*d*.

The candle-like lamps 160 are correspondingly placed in the corresponding tubes 152*c* and capable of sliding along the tubes 152*c*. Each candle-like lamp 160 includes a hollow pole 162, a light 164, the supporting leg 166, and a sensor 164*b*. A cover 162*a* is attached to an upper end of the hollow pole 162. The light 164 is mounted on the outer surface of the cover 162*a*. The supporting leg 166 extends from the hollow pole 162 adjacent to the lower end of the hollow pole 162. The sensor 164*b* is received in the hollow pole 162 and attached on the inner surface of the cover 162*a*. Each cover 162*a* defines a number of ducts 162*b* therein for allowing air to flow into the hollow pole 160. The sensor 164*b* electrically communicates with the controlling device 180 and is configured for detecting air current in the hollow pole 162 through the ducts 162*b* and sending a signal to the controlling device 180 if air current is detected. The controlling device 180 turns the light 164 and the driving device 140 off in response to the signal. The supporting legs 166 of the candle-like clamps 160 pass through the sliding slots 154*d* and is received in the guiding groove 190 defined by the curved upper cam end 114*a* and the curved lower cam end 128*a*.

The power source 170 received in the case 136 is configured for supplying an electric power for the light 164 and the driving device 140.

The controlling device 180 is mounted on the bottom surface 152*a* of the top sheet 152, and is electrically connected to the power source 170 and the light 164. The controlling device 180 may be remotely controlled, thereby controlling the light 164 and the driving device 140 when receiving a remote control signal.

In use, the controlling device 180 activates the light 164 and the driving device 140 when receiving the remote controlling signal. The rotor 144 of the driving device 140 is driven to rotate. However, because the rotor 144 is fixedly received in the shaft hole 116*a* defined on the substrate 112 which is placed on a surface of the table or a support (not label) via the pads 112*d*, a counterforce is applied to the body 142 of the driving device 140. Therefore, the bottom shell 130 and the rotatable platform 150 are driven to rotate relative to the substrate 112 by the counterforce because the body 142 is fixed on the base sheet 132. The supporting legs 166 are driven to slide along the guiding groove 190 by the rotation of the bottom shell 130 and the rotatable platform 150. When the supporting leg 166 slides in the guiding groove 190, the candle-like lamp 160 moves up on the curved upper cam end 114*a* of the cylindrical wall 114 or down by the curved lower cam end 128*a* or the gravity of the candle-like lamps 160 of the inner wall 128. The candle-like lamps 160 can move up and down relative to the electronic cake 100.

When the candle-like lamp 160 is blown, air flows into the hollow pole 162 through the ducts 162*b*. The sensors 164*b* can detect the airflow and send an electrical signal to the controlling device 180. In response to the electrical signal, the controlling device 180 turns off or inactivates the driving device 140 and the candle-like lamp 160.

In summary, the electronic cake 100 can provide rotation and up-and-down movements of the candle-like lamp 160 automatically and imitate a real candle being blown out. As a result, the electronic cake 100 can maintain or heighten people's interest.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An electronic cake comprising:

an inner base;

an outer base loosely sleeved on the inner base, and cooperatively defining a predetermined guiding groove between an upper rim of the inner base and a bottom surface of the outer base;

a driving device comprising a body and a rotor rotatably connected to the body, the rotor engaged with the inner base;

a bottom shell rotatably and drivably received in the inner base, the body of the driving device fixed in the bottom shell;

a rotatable platform fixedly attached to the bottom shell;

a plurality of candle-like lamps slidably attached on the rotatable platform, each candle-like lamp comprising a supporting leg extended out from a side wall of the rotatable platform and received in the predetermined guiding groove;

a controlling device fixed in the rotatable platform or the bottom shell and configured for controlling the driving device and the candle-like lamps; and a power source fixed in the bottom shell, electrically connected to the driving device and the candle-like lamps and configured for supplying electric power to the driving device and the candle-like lamps.

2. The electronic cake as claimed in claim 1, wherein each candle-like lamp comprises a hollow pole, a cover, and a light; the cover attached on an upper end of the hollow pole, the light mounted on the outer surface of the cover.

3. The electronic cake as claimed in claim 2, wherein the candle-like lamp further comprises a sensor received in the hollow pole and mounted on an inner surface of the cover; each cover of the hollow pole defines a number of ducts therein; and the sensor is electrically connected with the controlling device and configured for detecting airflow flowing through the ducts of the cover and sending a signal to the controlling device to turn off the light and the driving device according to the detected airflow.

4. The electronic cake as claimed in claim 3, wherein the supporting leg of the candle-like lamp extends from the hollow pole adjacent to the lower end of the hollow pole.

5. The electronic cake as claimed in claim 2, wherein the inner base comprises a substrate and a cylindrical wall on the substrate, and the cylindrical wall comprises a curved upper cam end facing away the substrate defining a cam surface of the guiding groove.

6. The electronic cake as claimed in claim 5, wherein the outer base comprises a cylindrical outer wall having a radius greater than that of the cylindrical wall of the inner base, a flange portion protruded outward from one end of the cylindrical outer wall; and the outer base is mounted on the substrate of the inner base by the flange portion.

7. The electronic cake as claimed in claim 6, wherein the outer base further comprises a projection protruded inwards from the other end of the cylindrical outer wall, an inner wall perpendicularly projecting downward from the projection corresponding to the cylindrical wall of the inner base and spaced from the cylindrical wall by a predetermined distance.

8. The electronic cake as claimed in claim 7, wherein the inner wall comprises a curved lower cam end corresponding to the curved upper cam end of the cylindrical wall and cooperatively forming the guiding groove.

9. The electronic cake as claimed in claim 8, wherein the curved lower cam end of the inner wall is aligned with the curved upper cam end of the cylindrical wall.

10. The electronic cake as claimed in claim 8, wherein the inner wall comprises an inner radius approximately equal to that of the cylindrical wall of the inner base.

11. The electronic cake as claimed in claim 1, wherein the bottom shell has a base sheet and cylindrical side wall extending upwards along a circumference of the base sheet, and the body of the driving device is mounted on the base sheet.

12. The electronic cake as claimed in claim 11, wherein the rotatable platform comprises a top sheet comprising a bottom surface, and a support extending from the bottom surface, and the support of the rotatable platform is mounted on the cylindrical side wall of the bottom shell.

13. The electronic cake as claimed in claim 12, wherein a rib protrudes upward from an upper end of the cylindrical side wall along the inner circumference of the cylindrical side wall and abuts the rotatable platform.

14. The electronic cake as claimed in claim 13, wherein the top sheet defines a number of through holes in the peripheral area thereof; and the rotatable platform further comprises a plurality of tubes extending downwards from the bottom surface and communicating with responding through holes.

15. The electronic cake as claimed in claim 14, wherein a plurality of sliding slots are defined on the support along the axis of the corresponding tubes and running through the adjacent tubes for allowing the supporting leg of the candle-like lamp extending out therefrom.

* * * * *